United States Patent [19]

Wilford

[11] 4,026,230

[45] May 31, 1977

[54] JIB BAG

[76] Inventor: Donald T. Wilford, Box 39, St. John Cruz Bay, V.I. 00830

[22] Filed: Apr. 20, 1976

[21] Appl. No.: 678,487

[52] U.S. Cl. ..... 114/104; 150/3; 150/52 R

[51] Int. Cl.[2] ..... B63H 9/06

[58] Field of Search ..... 114/102–108; 244/147, 148; 150/3, 52 R; 9/1.5; 135/6

[56] References Cited

UNITED STATES PATENTS

| | | | |
|---|---|---|---|
| 2,595,110 | 4/1952 | Steube et al. | 114/108 |
| 2,925,798 | 2/1960 | Colgate | 114/102 |
| 3,750,608 | 8/1973 | Middleton, Jr. | 114/103 |

*Primary Examiner*—Trygve M. Blix
*Assistant Examiner*—Stuart M. Goldstein
*Attorney, Agent, or Firm*—Andrew M. Wilford

[57] ABSTRACT

A generally triangular bag has a front edge provided with a separable fastener so that it can be enclosed around a compacted jib, around the jib hanks securing the luff to the jibstay, and around the lower portion of the jibstay. This bag is formed of a pair of triangular side panels having rear edges joined together at a backwardly convex seam, bottom edges joined by an eliptical bottom panel, and front edges each carrying a respective half of the separable fastener. At the upper and lower ends of the front edge the bag has holes permitting the jibstay to pass through the bag parallel to this front edge.

10 Claims, 5 Drawing Figures

FIG. 1
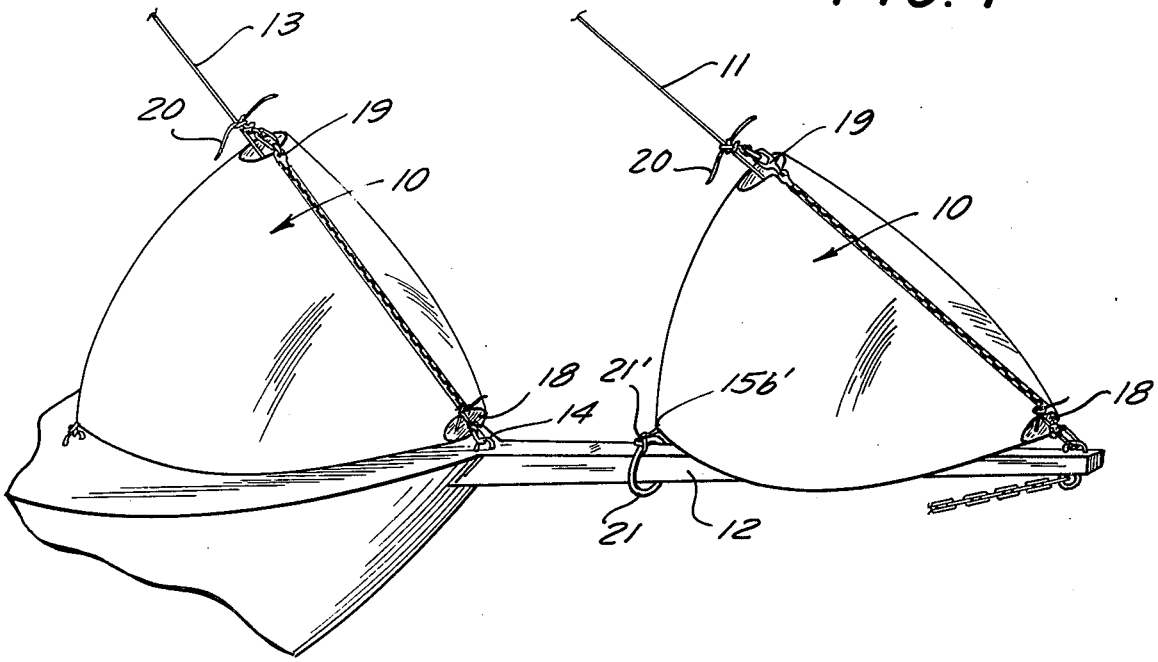
FIG. 2
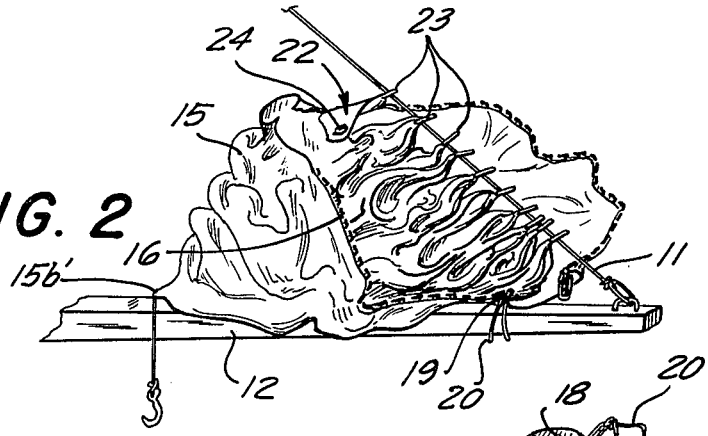
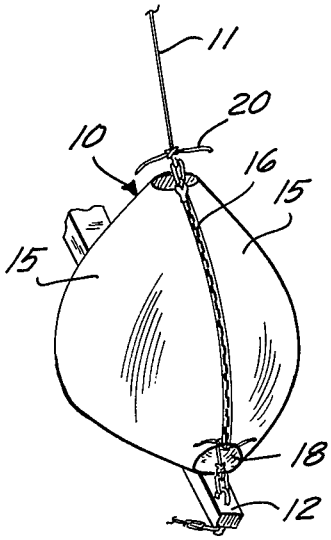
FIG. 3
FIG. 4
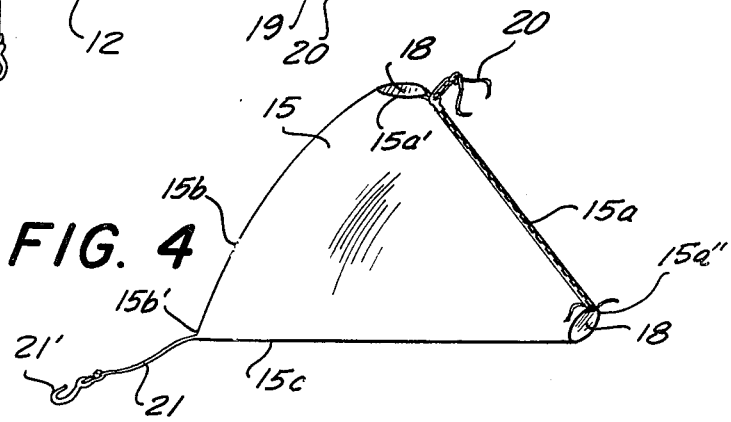
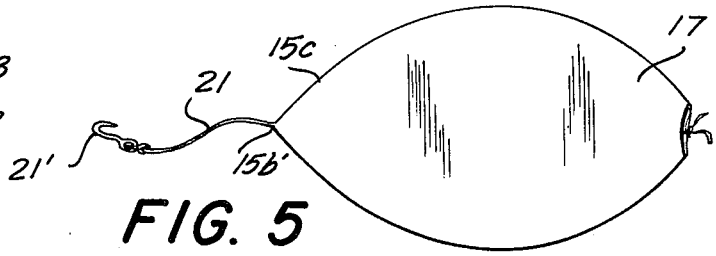
FIG. 5

JIB BAG

FIELD OF THE INVENTION

The present invention relates to a fore staysail assembly. More particularly this invention concerns a bag for stowing and holding a jib.

BACKGROUND OF THE INVENTION

A main or mizzen sail on a sailboat is customarily secured to or wound around its boom when not in use and protected by a sail cover. A jib or fore staysail is either stored by winding it around its stay or stuffing it into a sailbag after its hanks have been unsnapped from its stay.

Furling the jib around the jibstay is only possible when complicated and failure-prone gear is provided at ends of the stay. Thus the commonest procedure is to unhook the jib when it is to be stored and stuff it into a sailbag which itself is stowed in the cabin when not in use or tied down to the deck or bowsprit. Tucking the sail into the usually cylindrical bag is troublesome and time consuming. Furthermore the bag must be secured to a support–the bowsprit for a flying jib or the deck for a working jib–with its jib inside, or the entire sail must be removed and stowed in the bag below decks.

When the jib is to be used again after storage in a conventional sailbag it is necessary, after fetching the bagged jib from below, to pull the jib out of the bag, attach the head to the jib halyard, secure the hanks to the jibstay, and attach the tack to the appropriate eye on the deck or bowsprit when the sail has been removed altogether to keep the ungainly sailbag out of the way.

This procedure is complicated and frequently takes up valuable time at the start of a sail. Furthermore the stowed jib is unsightly when left on deck and inconveniently out-of-the-way when stowed below.

OBJECTS OF THE INVENTION

It is therefore an object of the present invention to provide an improved sail assembly.

Another object is the provision of a jib bag which allows the jib to be stowed neatly and yet readily put back into service.

SUMMARY OF THE INVENTION

These objects are attained according to the present invention in an assembly that allows the jib to be encased neatly in a protective bag while still attached at its luff to the jib halyard, deck or bowsprit eye, and jibstay. Thus in accordance with the present invention a generally triangular bag is provided having a bottom edge which lies on the boat support, deck or bowsprit, a back edge which extends from this support up to the jibstay, and a front edge extending along the jibstay and provided with a separable fastener that allows the bag to be closed around the foot portion of the jibstay to which the jib hanks are still attached.

With this arrangement the jib may be on deck when not in use, encased in a neat and even attractive bag that is shaped to fit under jibstay in an out-of-the-way location. The sail is stowed after being dropped simply by unhooking its clew and pulling the bag up around the sail, then closing the front edge of the bag in front of the jibstay. To put the sail into service the bag need merely be opened along the jibstay, the clew attached to the jib sheets, and the sail hauled up, an operation that can be carried out in seconds.

If desired the sailbag according to the present invention can be used for below-decks storage of the sail. In this case the jib is unhooked from the stay, tack, and halyard and stowed below after simply zipping the bag up aft of the stay.

According to further features of the invention the bag has a pair of generally triangular side panels joined together at their bottom edges by an eliptical bottom panel, and at their back edges along a backwardly convex seam. The front edge is provided with a separable fastener of the slide or zip type, leaving an open gap or hole at the corners at the ends of the front edge so that the jibstay may pass through the bag. The rear corner is provided with a tie or the like for securing it to the deck or bowsprit. It is possible to provide another fastener along the seam at the back edges of the side panels in order to open the bag up completely.

DESCRIPTION OF THE DRAWING

FIG. 1 is a side view of a front of a sailboat equipped with two sail assemblies according to this invention, FIG. 2 is a side view of one of the assemblies with the sailbag opened, FIG. 3 is a front perspective view of the one assembly, FIG. 4 is a side view of the sailbag according to this invention, and FIG. 5 is a bottom view of the bag of FIG. 4.

SPECIFIC DESCRIPTION

As shown in FIG. 1 identical sail bags 10 encase the yankee jib carried on the stay 11 attached to the tip of the bowsprit 12 and the working jib carried on the stay 13 secured to the deck 14.

The bag 10 as shown in FIGS. 3–5 comprises a pair of generally triangular side panels 15 each having a front edge 15*a* carrying a half 16 of a separable zipper-type slide fastener and a back edge 15*b* that is backwardly convex and attached to the similar back edge 15*b* of the other side panel 15. The bottom edges 15*c* of the side panels 15 are straight and secured to edges of an eliptical bottom panel 17. The panels 15 are cut off at their corners 15*a* 'and 15*a*''to form openings 18.

The slider 19 of the slide fastener 16/16 is provided with a tie 20 which can be knotted around the jibstay 11 or 13. At their rear corners 15*b*'the side panels are provided with a tie 21 having a hook 21' allowing it to be looped around the bowsprit 12 or an eye on the deck 14 to hold the bag down.

In order to bag the yankee jib 22 as shown in FIG. 2 this sail is pulled down without unattaching its hanks 23 from the jibstay 11. The jib halyard is disconnected from the clew 24 of the sail and the entire sail 22 is simply tucked into the conical bag. The zipper halves 16 are then fastened together and the slider 19 pulled up. Then the tie 20 is secured around the jibstay 11 and the tie 21 around the bowsprit 12.

To use the sail the tie 20 is unattached, the slider 19 displaced all the way down, the jib halyard attached to the clew, and the jib pulled up. The bag can be stowed below or left on deck. If desired the jib halyard can be left attached to the clew 24 in the bag.

With this arrangement there is no need to unattach the hanks 23 from the jibstay and the sail can be stowed on deck in a very neat and out-of-the-way manner. Unbagging of the sail is a very fast operation so that the normally lengthy task of preparing to sail is shortened enormously.

The panels 15 and 17 are made of weather-resistant textile material. The fastener 16/16 is preferably of the synthetic-resin type. The ties 20 and 21 are made of Dacron or similar line.

I claim:

1. A jib bag comprising:

a pair of similar generally triangular side panels each having a front edge, a bottom edge, and a back edge meeting at corners;

means connecting said bottom edges and said back edges together; and a separable fastener having a pair of joinable halves each extending along a respective front edge between locations thereon inset from the respective corners thereof and leaving at each of said respective corners an open hole when joined together, whereby a bunched-up jib secured to its jibstay may be enclosed between said side panels with said jibstay passing through said bag at said holes.

2. The bag defined in claim 1 wherein said means includes a bottom panel secured to and extending between said bottom edges.

3. The bag defined in claim 2 wherein said bottom panel is generally eliptical.

4. The bag defined in claim 1 wherein said back edges are convexly curved away from said front edges.

5. The bag defined in claim 1 wherein said front edges lie at an angle to the respective bottom edges equal to the angle said jibstay forms with a support to which its lower end is attached.

6. The bag defined in claim 1 wherein said separable fastener is a slide fastener having a pair of coupling elements each constituting one of said halves and a slider displaceable therealong.

7. The bag defined in claim 1 wherein said side panels are textile having a warp extending generally parallel to said front edges.

8. The bag defined in claim 1, further comprising a tie at the uppermost end of said back edge for securing said bag to said jibstay.

9. The bag defined in claim 1, further comprising a tie at a bottom edges for securing said bag to a support.

10. A sail assembly comprising:

a generally horizontal support;

a jibstay extending upwardly at an acute angle from said support;

a jib having a luff a plurality of hanks securing said luff slidably along said jibstay; and a bag containing said jib in a compacted condition thereof, enclosing said hanks, and surrounding a portion of said jibstay adjacent said support, said bag having a front edge generally parallel to said jibstay and provided with a separable fastener.

* * * * *